US010721995B2

(12) United States Patent
Mills

(10) Patent No.: US 10,721,995 B2
(45) Date of Patent: Jul. 28, 2020

(54) STRUCTURE FOR ATTACHMENT TO AGLETS, ZIPPERS, AND CORDS

(71) Applicant: Funletz LLC, Syracuse, NY (US)

(72) Inventor: Zachary Mills, Camillus, NY (US)

(73) Assignee: Funletz, LLC, Syracuse, NY (US)

( * ) Notice: Subject to any disclaimer, the term of this patent is extended or adjusted under 35 U.S.C. 154(b) by 0 days.

(21) Appl. No.: 16/389,964

(22) Filed: Apr. 21, 2019

(65) Prior Publication Data

US 2019/0320761 A1 Oct. 24, 2019

Related U.S. Application Data

(60) Provisional application No. 62/660,286, filed on Apr. 20, 2018.

(51) Int. Cl.

| | |
|---|---|
| ***A41D 27/08*** | (2006.01) |
| ***A44B 19/26*** | (2006.01) |
| ***A43B 23/24*** | (2006.01) |

(52) U.S. Cl.

CPC ..... *A43B 23/24* (2013.01); *A41D 27/08* (2013.01); *A44B 19/262* (2013.01)

(58) Field of Classification Search

CPC ..... A41D 27/08; A43B 23/24; A44B 19/262
See application file for complete search history.

(56) References Cited

U.S. PATENT DOCUMENTS 3,994,521 A * 11/1976 Van Gompel ..... G09F 3/0352 292/319
4,075,742 A * 2/1978 Remark ..... G09F 3/0317 24/453
4,534,192 A * 8/1985 Harshbarger ..... E05B 63/20 109/59 R
4,642,854 A * 2/1987 Kelly ..... F16G 11/042 24/129 R
4,648,159 A * 3/1987 Dougherty ..... A41F 1/04 24/129 R
4,681,356 A * 7/1987 Brammall ..... G09F 3/0352 24/115 G
4,846,011 A * 7/1989 Gaffney ..... B23Q 5/408 74/89.38
5,222,776 A * 6/1993 Georgopoulos ..... G09F 3/0352 292/252
5,352,003 A * 10/1994 Bystry ..... G09F 3/0352 292/252
5,450,657 A * 9/1995 Georgopoulos ..... G09F 3/0317 24/115 M
5,582,447 A * 12/1996 Leon ..... G09F 3/0317 24/115 M
5,647,620 A * 7/1997 Kuenzel ..... B65D 55/06 292/307 R
5,820,176 A * 10/1998 Leon ..... F16G 11/14 292/323
6,039,365 A * 3/2000 Rogatnev ..... F16B 37/0857 292/318

(Continued)

*Primary Examiner* — Robert Sandy
*Assistant Examiner* — David M Upchurch
(74) *Attorney, Agent, or Firm* — Brian M. Dingman; Dingman IP Law, PC

(57) ABSTRACT

An ornamental structure that is constructed and arranged to be coupled to an end of a cord includes a body with a through-hole and a cord-end receiving cavity that has a width about equal to a diameter of the cord, where the through hole and cavity are proximate one another.

19 Claims, 4 Drawing Sheets

(56) References Cited

U.S. PATENT DOCUMENTS 6,131,969 A * 10/2000 Natkins ..... B65D 63/06 24/136 R
6,155,617 A * 12/2000 Kuenzel ..... G09F 3/0352 292/307 R
6,192,559 B1 * 2/2001 Munsell, Jr. ..... A43C 7/00 24/128
6,662,415 B1 * 12/2003 Lin ..... A43C 7/00 24/129 R
7,073,828 B2 * 7/2006 Foigel ..... B65D 90/008 24/115 L
7,243,963 B2 * 7/2007 De Lima Castro ... G09F 3/0352 292/307 R
7,478,847 B2 * 1/2009 Kleynerman ..... G09F 3/037 292/315
8,544,902 B2 * 10/2013 Remark ..... G09F 3/0317 292/307 R
9,558,682 B2 * 1/2017 Dreisbach ..... F16G 11/14
9,803,399 B2 * 10/2017 Benning ..... E05B 73/00
9,814,281 B2 * 11/2017 Fisher ..... A43C 9/06
10,194,715 B2 * 2/2019 Park ..... A43C 7/00
2003/0070268 A1 * 4/2003 Ross ..... A43C 7/00 24/712.1
2003/0126726 A1 * 7/2003 Hsu ..... A43C 3/00 24/712.1
2005/0273988 A1 * 12/2005 Christy ..... A43C 7/00 24/712.1
2008/0148538 A1 * 6/2008 Iten ..... A43C 9/04 24/715.4
2010/0186205 A1 * 7/2010 Stehman, Jr. ..... A43B 3/0005 24/715.4
2011/0016680 A1 * 1/2011 Chang ..... A43C 7/00 24/712.5
2012/0291242 A1 * 11/2012 Donnadieu ..... A43B 5/0411 24/712.7
2014/0020263 A1 * 1/2014 Theuvenet ..... A43B 3/0005 36/50.1
2014/0208551 A1 * 7/2014 Ben-Arie ..... A43C 7/04 24/712.9
2015/0272277 A1 * 10/2015 Munsell ..... A43C 7/08 24/712.6
2018/0020779 A1 * 1/2018 Ben-Arie ..... A43C 7/08 24/68 SK

* cited by examiner

STRUCTURE FOR ATTACHMENT TO AGLETS, ZIPPERS, AND CORDS

CROSS-REFERENCE TO RELATED APPLICATION

This application claims priority of Provisional Patent Application Ser. No. 62/660,286, filed on Apr. 20, 2018, the entire disclosure of which is incorporated herein by reference for all purposes.

BACKGROUND

This disclosure relates to an ornamental structure that can be attached to a zipper or a cord.

Ornamenting the ends of shoelaces, drawstrings and other cords, and zippers, can be a way to show interest or spirit, or just have fun.

SUMMARY

All examples and features mentioned below can be combined in any technically possible way.

Featured in this disclosure are ornamental structures that are arranged to be attached to aglets, zippers, and cords such as the drawstrings of clothing and shoelaces. Aglets are the small sheaths at the ends of shoelaces, drawstrings for clothing such as hooded sweatshirts, and other types of cords. The subject structures include a through-hole through which the shoelace or drawstring is passed, and an adjacent cavity that is sized and shaped to accept and retain an aglet, or the end of the cord if the cord end does not include an aglet. The subject structures can be coupled to a zipper puller via an intermediate coupling device that can be looped through the puller and pushed through and anchored in the through-hole of the ornamental structure.

The ornamental structures can have a desired appearance. The ornamental structures thus allow a person to ornament shoelaces and drawstrings and zippers and the like with desired characteristics, such as items that represent sports, sports teams, schools, animals, licensed characters, and virtually any other object, institution, or event. Other examples include emojis, logos, letters, numbers, food, flags, and symbols such as musical notes, flowers, peace sign, etc.

In one aspect, an ornamental structure that is constructed and arranged to be coupled to an end of a cord includes a body with a through-hole and a cord-end receiving cavity that has a width about equal to a diameter of the cord, where the through hole and cavity are proximate one another. They may be generally parallel.

Examples may include one of the above and/or below features, or any combination thereof. The cord may have an aglet at an end thereof. The cavity may have a width about equal to a diameter of the aglet. The through hole may be wider than the cord. The body may be solid except for the through-hole and the cavity. The body may be made from a rubber material or an elastomer material. The body may be made from a material having a hardness of about 50 Shore A.

Examples may include one of the above and/or below features, or any combination thereof. The ornamental structure may further comprise a coupling device that is configured to be coupled to a zipper puller and the ornamental structure. The coupling device may comprise an enlarged head and two spaced depending flexible legs. The legs may each comprise an enlarged end. The legs may be configured to fit entirely through the body through-hole. The leg ends may be spaced apart more than the diameter of the through-hole and sit outside of the through-hole.

In another aspect, a method of coupling an ornamental structure to the end of a cord that comprises an aglet, wherein the structure comprises a body with a through-hole and a cord-end receiving cavity that has a width about equal to a diameter of the cord, where the through hole and cavity are proximate one another and are generally parallel, includes pushing the aglet into and through the entire length of the through-hole, then pulling enough of the cord through the through-hole to allow the aglet to be pushed into the cavity, and then pushing the aglet into the cavity.

Examples may include one of the above and/or below features, or any combination thereof. The method may further comprise pulling slack in the cord back through the through-hole. Slack in the cord may be pulled such that the cord projects as little as possible from the cavity and from the through-hole opening adjacent the cavity. The method may further comprise placing a coupling device around a zipper puller and passing two spaced depending flexible legs of the coupling device entirely through the body through-hole, wherein the legs comprise enlarged ends that are spaced apart more than the diameter of the through-hole and sit outside of the through-hole.

BRIEF DESCRIPTION OF THE DRAWINGS

The drawings illustrate non-limiting examples of the subject ornamental structures and manners in which they can be used.

DETAILED DESCRIPTION

Figure 1C:
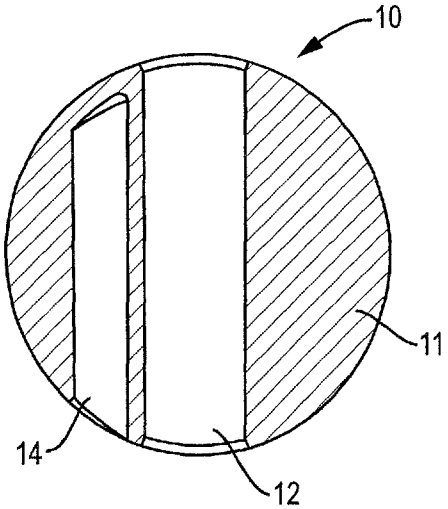
FIGS. 1A-1C are front, side, and cross-sectional views, respectively, of an exemplary ornamental structure that looks like a soccer ball.
Figure 1B:
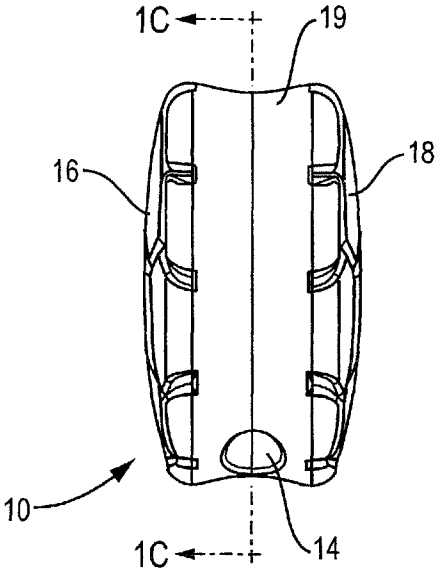
Figure 1A:
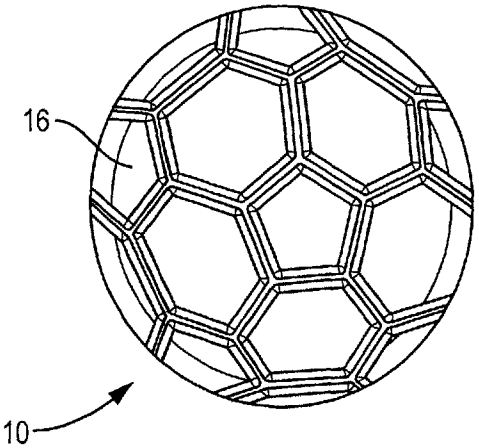

Ornamental structure 10, FIGS. 1A-1C, is a mostly solid article that can be made from an appropriate material with the properties described herein. One exemplary, non-limiting material is a rubber material or a thermoplastic elastomer such as a silicone. In one non-limiting example the material has a hardness in the range of about 50 Shore A; this material is soft enough to be squeezed/manipulated to allow the structure to be coupled to the end of a lace or cord, as further described below. Structure 10 may have (but need not have) opposed generally flat or slightly domed surfaces 16 and 18 that can be constructed and arranged to present a desired appearance. In this non-limiting example, faces 16 and 18 are each arranged to look like a view of a soccer ball, with a plurality of adjacent pentagonal shapes that look like the panels of a soccer ball. The appearance can be varied and as desired, but is not important to the function. Central portion 19 comprises through-hole 12 and closely adjacent, generally parallel blind hole (i.e., cavity) 14. Through-hole 12 is preferably wider than the typical diameter of an aglet, and cavity 14 has a width that is preferably about equal to the aglet diameter. Typical, non-limiting dimensions (in inches) include: structure width 0.875; structure thickness 0.50; cavity depth 0.74.

The ornamental structure is an accessory for clothing, installed by fitting over drawstring and shoelace aglets. The structure has a hole 12 in the center that goes all the way through (a "through-hole") that is sized to allow aglets of different sizes to fit inside. In non-limiting examples the hole is about 0.23 inches in diameter. Through-hole 12 is slightly wider than a typical aglet. However, some aglets have a greater diameter. In this case, the structure is gently squeezed to enlarge the through-hole. The material has a durometer that allows the structure to conform to different sized aglets with the adjacent cavity that is sized and shaped to accept and retain an aglet. Cavity 14 may have a diameter of about 0.13 inches.

Figure 2A:
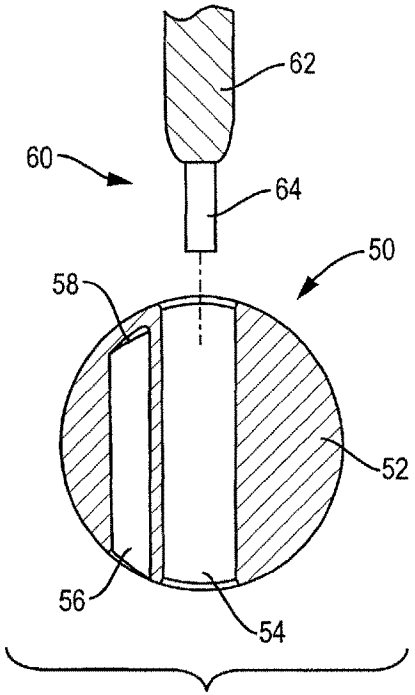
FIGS. 2A-2D illustrate an ornamental structure being coupled to the end of a shoelace, drawstring, or other cord with an aglet.
Figure 2B:
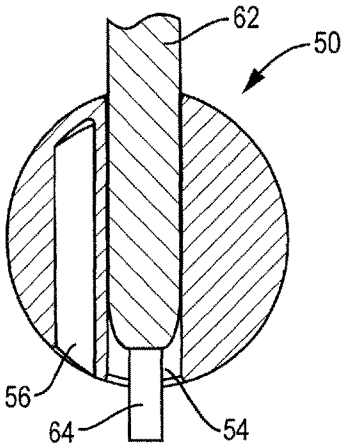
Figure 2C:
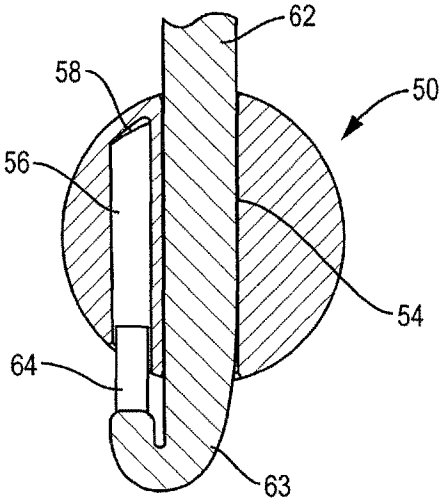
Figure 2D:
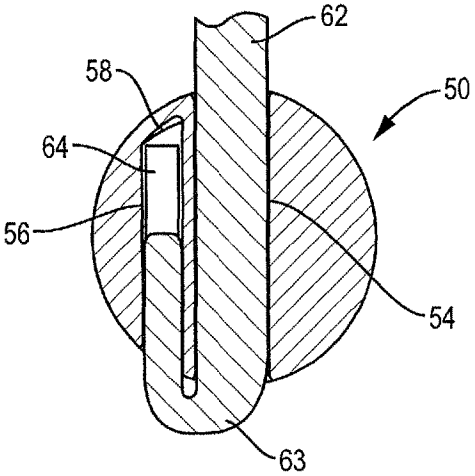

FIGS. 2A-2D illustrate an ornamental structure 50 (in cross-section) being coupled to the end of a shoelace, drawstring, or other cord 60 comprising cord portion 62 and terminal aglet 64. Structure 50 has through-hole 54 that is wider than aglet 64, and adjacent aglet-receiving cavity 56 that has a width about equal to the diameter of aglet 64. To couple structure 50 to cord 60, aglet 64 is pushed into hole 54 and fed through the entire length of the hole, as shown in FIG. 2B. The aglet can then be grasped and pulled, to pull more of cord portion 62 thorough hole 54, enough to allow the aglet to be pushed into cavity 56, FIG. 2C, and ideally pushed all the way or almost all the way to cavity end wall 58. Any slack in cord portion 62 is then preferably but not necessarily pulled back through hole 54 such that cord portion 62 projects as little as possible from hole 54 and cavity 56, and cord portion 62 lies close to the surface of structure 50 between hole 54 and cavity 56 as shown in FIG. 2D. After structure 50 has been installed as shown and described, if structure 50 is pulled down, the friction of aglet 64 in cavity 56, together with the bend 63 in cord portion 62 where it runs out of hole 54 and into cavity 56, provides a resistive force that helps to keep structure 50 in place. If there is no aglet, the end of the cord is fitted into cavity 56.

Figure 3B:
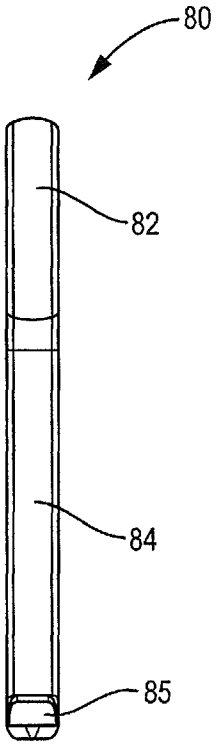
FIGS. 3A and 3B are front and side views of a coupling device that allows an ornamental structure to be coupled to the puller of a zipper.
Figure 3A:
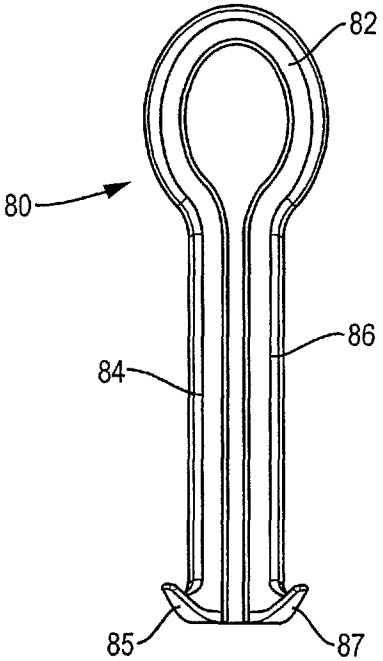

FIGS. 3A and 3B are front and side views of a coupling device 80 that allows an ornamental structure of the types described above to be coupled to the puller of a zipper. Device 80 has a shape similar to that of a cotter pin, with enlarged head 82 with a central opening and depending flexible legs 84 and 86, each with slightly enlarged ends 85 and 87. The legs are slightly apart in the relaxed state (shown in FIGS. 3A and 3B), and can be squeezed together to fit through the through-hole of a decorative structure. When the legs are relaxed, the leg ends are farther apart than the diameter of the through-hole so that the legs cannot be removed from the ornamental structure unless the legs are squeezed together and pulled out of the through-hole. Device 80 can be molded using polypropylene.

Figure 4C:
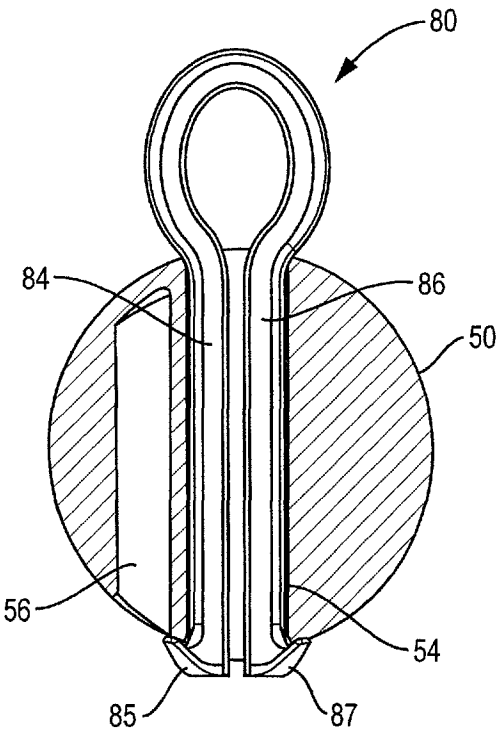
FIGS. 4A-4C illustrate an ornamental structure being coupled to the puller of a zipper by the coupling device of FIGS. 3A and 3B.
Figure 4B:
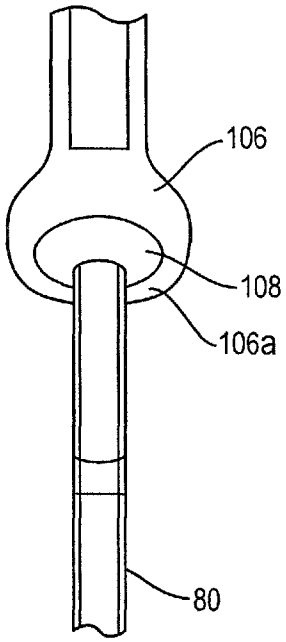
Figure 4A:
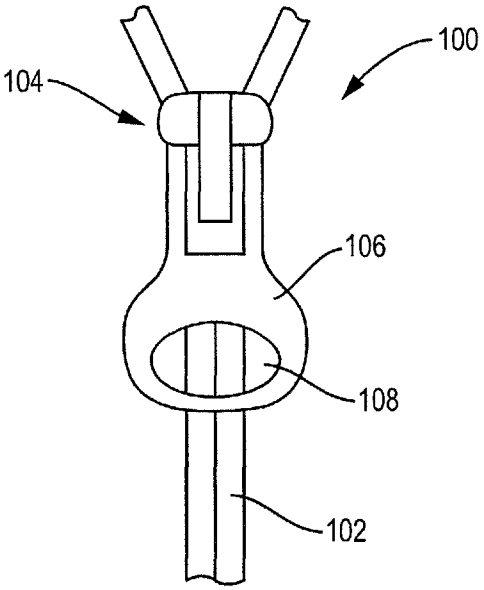

FIGS. 4A-4C illustrate an ornamental structure being coupled to the puller of a zipper by the coupling device of FIGS. 3A and 3B. FIG. 4A shows zipper 100 with slider 104 that rides along teeth or chain 102, as is well known. Slider 104 has puller 106 with opening 108. Coupling device 80 is hung from puller 106 by pushing puller end 106*a* between legs 84 and 86. See FIG. 4B. Legs 84 and 86 are then squeezed together. The width of the side-by-side hook ends 85 and 87 when pushed together is slightly less than the diameter of through-hole 54 of ornamental structure 50. This allows structure 50 to be pushed over legs 84 and 86 until ends 85 and 87 project through the end of opening 54. Legs 85 and 87 will then naturally spring back to their normal rest positions shown in FIG. 4C, where the overall width of ends 85 and 87 is greater than the diameter of hole 54, so that the structure 50 can't be pulled off of coupling device 80 unless legs 84 and 86 are pushed back together. Structure 50 thus retains the ornamental structure on the zipper pull.

A number of implementations have been described. Nevertheless, it will be understood that additional modifications may be made without departing from the scope of the inventive concepts described herein, and, accordingly, other examples are within the scope of the following claims.

What is claimed is:

1. An ornamental structure that is constructed and arranged to be coupled to an end of a cord, wherein the cord has an aglet at an end thereof, the structure comprising:

a body with first and second opposed surfaces, and a through-hole extending entirely though the body from the first surface to the second surface; and a cord-end receiving blind hole that has a width about equal to a diameter of the cord, where the through hole and blind hole are proximate one another, and where the blind hole extends from the first surface through most of the body but not through the second surface.

2. The ornamental structure of claim 1, wherein the blind hole has a width about equal to a diameter of the aglet.

3. The ornamental structure of claim 1, wherein the through hole is wider than the cord.

4. The ornamental structure of claim 1, wherein the body is solid except for the through-hole and the blind hole.

5. The ornamental structure of claim 4, wherein the body is made from a rubber material or an elastomer material.

6. The ornamental structure of claim 4, wherein the body is made from a material having a hardness of about 50 Shore A.

7. The ornamental structure of claim 1, further comprising a coupling device that is configured to be coupled to a zipper puller and the ornamental structure.

8. The ornamental structure of claim 7, wherein the coupling device comprises an enlarged head with an open center and two spaced depending flexible legs.

9. The ornamental structure of claim 8, wherein the legs each comprise an enlarged end.

10. The ornamental structure of claim 9, wherein the legs are configured to fit entirely through the body through-hole.

11. The ornamental structure of claim 10, wherein the leg ends are spaced apart more than the diameter of the through-hole and sit outside of the through-hole.

12. The ornamental structure of claim 1, wherein the through hole and blind hole are parallel.

13. A method of coupling an ornamental structure to the end of a cord that comprises an aglet, wherein the structure comprises a body with first and second opposed surfaces, and a through-hole extending entirely though the body from the first surface to the second surface, and a cord-end receiving blind hole that has a width about equal to a diameter of the cord, where the through hole and blind hole are proximate one another and are generally parallel, and where the blind hole extends from the first surface through most of the body but not through the second surface comprising:

pushing the aglet into and through the entire length of the through-hole; then pulling enough of the cord through the through-hole to allow the aglet to be pushed into the blind hole; and then pushing the aglet into the blind hole.

14. The method of claim 13, further comprising pulling slack in the cord back through the through-hole.

15. The method of claim 14, wherein slack in the cord is pulled such that the cord projects as little as possible from the blind hole and from the through-hole opening adjacent the blind hole.

16. An ornamental structure that is constructed and arranged to be coupled to an end of a cord, the structure comprising:

a body with a through-hole;

a cord-end receiving blind hole that has a width about equal to a diameter of the cord, where the through hole and blind hole are proximate one another; and a coupling device that is configured to be coupled to a zipper puller and the ornamental structure, wherein the coupling device comprises an enlarged head with an open center and two spaced depending flexible legs.

17. The ornamental structure of claim 16, wherein the legs each comprise an enlarged end.

18. The ornamental structure of claim 17, wherein the legs are configured to fit entirely through the body through-hole.

19. The ornamental structure of claim 18, wherein the leg ends are spaced apart more than the diameter of the through-hole and sit outside of the through-hole.

* * * * *